US007557297B2

(12) United States Patent
Axland et al.

(10) Patent No.: US 7,557,297 B2
(45) Date of Patent: Jul. 7, 2009

(54) MOUNTABLE POWER STRIPS

(75) Inventors: Mark Axland, Charlotte, NC (US); Cheryl Axland, Charlotte, NC (US); Kevin Dahlquist, Charlotte, NC (US); Daniel Lee Bizzell, Davidson, NC (US); Ian D. Kovacevich, Charlotte, NC (US)

(73) Assignee: Axland Comec, LLC, Charlotte, NC (US)

( * ) Notice: Subject to any disclaimer, the term of this patent is extended or adjusted under 35 U.S.C. 154(b) by 0 days.

(21) Appl. No.: 12/117,661

(22) Filed: May 8, 2008

(65) Prior Publication Data

US 2008/0277133 A1 Nov. 13, 2008

Related U.S. Application Data

(60) Provisional application No. 60/916,792, filed on May 8, 2007.

(51) Int. Cl.
*H01H 9/02* (2006.01)

(52) U.S. Cl. ..... 174/53; 174/135; 439/652; 439/655; 362/806

(58) Field of Classification Search ..... 174/53, 174/135; 439/121, 115, 535, 652, 574, 650, 439/653, 640, 655, 651, 170; D13/39.8, D13/160; 362/806
See application file for complete search history.

(56) References Cited

U.S. PATENT DOCUMENTS

| | | | |
|---|---|---|---|
| 1,891,341 | A | 12/1932 | Barocas |
| 2,047,045 | A | 7/1936 | Veenboer |
| 2,230,900 | A | 2/1941 | Neitzke |
| 2,453,695 | A | 11/1948 | Belling |
| 2,465,419 | A | 3/1949 | Barany |
| 2,474,356 | A | 6/1949 | Harris |
| 2,533,222 | A | 12/1950 | Cohen |
| 2,759,095 | A | 8/1956 | Kline |
| 3,049,688 | A | 8/1962 | Sinopoli |
| 3,662,319 | A | 5/1972 | Culver |
| 3,723,723 | A | 3/1973 | Lerner |
| 3,752,407 | A | 8/1973 | Baugh et al. |
| 3,770,951 | A | 11/1973 | Corelli et al. |

(Continued)

OTHER PUBLICATIONS

"Letter Accompanying IDS Submission", filed by Applicant concurrently herewith, 1 page.

*Primary Examiner*—Dhiru R Patel
(74) *Attorney, Agent, or Firm*—Tillman Wright, PLLC; Chad D. Tillman; Jeremy C. Doerre

(57) ABSTRACT

A mountable power strip includes: first and second arm sections each including a plurality of electrical receptacles; a coupling assembly configured to couple the arm sections together for rotational movement relative to each other about a rotational axis; and a ratcheting assembly configured to define degrees of relative rotational movement about the rotational axis between the arm sections. The coupling assembly includes a connecting member secured in fixed disposition to the first arm section that retains the arm sections together. The ratcheting assembly includes a release member retained on the connecting member that is axially slidable relative thereto. The release member includes teeth that engage teeth of the second arm section. A biasing element retained between the connecting member and the release member is configured to bias the release member toward the rim cap such that the teeth of the release member engage the teeth of the rim cap.

20 Claims, 16 Drawing Sheets

U.S. PATENT DOCUMENTS

| | | | | |
|---|---|---|---|---|
| 4,099,824 | A | 7/1978 | Schoppelrey | |
| 4,174,532 | A | 11/1979 | Kelley | |
| 4,764,128 | A | 8/1988 | Cheng | |
| 4,875,878 | A | 10/1989 | Meyer | |
| 5,150,963 | A | 9/1992 | Hill | |
| 5,306,165 | A * | 4/1994 | Nadeau | 439/115 |
| 5,422,801 | A | 6/1995 | Sangalli | |
| D365,803 | S | 1/1996 | Boesel et al. | |
| 5,964,618 | A | 10/1999 | McCarthy | |
| D428,598 | S | 7/2000 | Carter-Williams et al. | |
| D436,922 | S | 1/2001 | Stekelenburg | |
| D437,582 | S | 2/2001 | Stekelenburg | |
| 6,243,257 | B1 | 6/2001 | Ester | |
| D467,875 | S | 12/2002 | Barger et al. | |
| 6,540,554 | B2 | 4/2003 | McCarthy | |
| 6,581,890 | B2 | 6/2003 | Johnson et al. | |
| 6,663,435 | B2 | 12/2003 | Lincoln, III et al. | |
| 6,933,447 | B1 * | 8/2005 | Marc | 174/135 |
| 7,148,419 | B1 * | 12/2006 | Harrigan | 174/53 |
| 7,186,146 | B1 * | 3/2007 | Chang et al. | 439/650 |
| 7,223,122 | B2 * | 5/2007 | Mori | 439/574 |
| 7,347,734 | B1 * | 3/2008 | Teitelbaum | 439/652 |
| 7,394,019 | B2 * | 7/2008 | Gesue | 174/53 |
| 7,435,901 | B2 * | 10/2008 | Mori et al. | 174/53 |
| 7,442,090 | B2 * | 10/2008 | Mori et al. | 439/652 |
| 2008/0066943 | A1 | 3/2008 | Axland et al. | |

* cited by examiner

22000'

22000′

MOUNTABLE POWER STRIPS

I. CROSS-REFERENCE TO RELATED APPLICATIONS

The present application is a nonprovisional patent application of, and claims priority under 35 U.S.C. §119(e) to, U.S. Provisional Patent Application Ser. No. 60/916,792, filed May 8, 2007, which provisional patent application is incorporated herein by reference.

Moreover, U.S. patent application Ser. No. 11/746,040, filed May 8, 2007, and the publication thereof, namely, U.S. Patent Application Publication No. 2008/0066943, are each incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

The present invention generally relates to various new designs for power strips and, in particular, to designs for a power strip that includes structure that facilitates the mounting or attachment of the power strip to an object.

IV. SUMMARY OF THE INVENTION

The present invention includes many aspects and features. Moreover, while power strips of the present invention may be used by mounting them to trees and, in particular, to Christmas Trees, the present invention is not limited to use only with trees. Indeed, as will become apparent from the following, power strips of the present invention have broad applicability and can be mounted or attached to many different objects and structures apart from trees, such as a portion of a stud in the frame of a building that is under construction, or a portion of a work bench or table.

In accordance with an aspect of the invention disclosed and claimed in the present application, an apparatus includes: a plurality of arm sections, at least one of the plurality of arm sections including a plurality of electrical receptacles; a coupling assembly configured to couple together a first arm section and a second arm section of the plurality of arm sections for rotational movement relative to each other about a rotational axis; and a ratcheting assembly configured to define degrees of relative rotational movement about the rotational axis between the first arm section and the second arm section. The first and second arm sections are configured to transition between a first configuration, in which the first and second arm sections are oriented in an open position for receipt of an object between the first and second arm sections; and a second configuration, in which the first and second arm sections are oriented in a closed position, the first and second arm sections being closer to one another than when in the first configuration for clamping engagement with the object.

In accordance with this aspect, the coupling assembly includes a connecting portion of the first arm section received within a cylindrical recess of the second arm section. The connecting portion includes a circumferential edge disposed in abutting engagement with a circumferential ledge of the second arm section such that the second arm section is retained to the first arm section. The abutment of the connecting portion with the second arm section serves to retain the first and second arm sections to one another for relative rotational movement about the rotational axis while precluding relative axial movement along the rotational axis.

Additionally, the ratcheting assembly includes a release member retained on the connecting portion and configured for sliding axial movement relative to the connecting portion, but disposed in fixed disposition relative to the connecting portion with respect to rotational movement about the rotational axis. The release member includes teeth elements disposed along a circumferential area thereof that protract in the axial direction. The second arm section further includes an engaging portion having teeth elements, and a biasing element retained between the connecting portion and the release member is configured to bias the release member such that the teeth elements of the release member engage the teeth elements of the engaging portion of the second arm section. Due to the shape of the inclined teeth elements and their relative dispositions, relative rotational movement between the first arm section and the second arm section away from the open position toward the closed position is permitted, and relative rotational movement between the first arm section and the second arm section away from the closed position toward the open position is inhibited, when the release member is not depressed and the teeth are in abutment with one another. When the release member is depressed and the teeth are out of abutment with one another, relative rotational movement between the first arm section and the second arm section toward the open position is uninhibited.

In a feature of this aspect, the apparatus further includes a torsion spring that is disposed in abutting engagement with both the second arm section and with the connecting portion of the first arm section and configured to bias the first and second arm sections from the closed position toward the open position, whereby the arm sections are spring-biased toward an open position for receiving an object therebetween for mounting of the apparatus to the object.

In a feature of this aspect, the connecting portion of the first arm section comprises a connecting member that is secured to a body of the first arm section in fixed disposition relative thereto.

In a feature of this aspect, the engaging portion of the second arm section comprises a rim cap that is received within the cylindrical recess of the second arm section and that includes a circular flange extending outside of the second arm section to overlay and cover a surrounding edge of the cylindrical recess of the second arm section. The rim cap is secured in fixed disposition relative to the second arm section, an opening in the rim cap receives therethrough an extended portion of the connecting portion of the first arm section that defines a release button, and the rim cap further includes a circumferential area along which the teeth elements are arranged.

In another feature of this aspect, the biasing element of the ratcheting assembly comprises a compression spring.

In accordance with another aspect of the invention disclosed and claimed in the present application, an apparatus includes: a plurality of arm sections, at least one of the plurality of arm sections including a plurality of electrical receptacles; a coupling assembly configured to couple together a first arm section and a second arm section of the plurality of arm sections for rotational movement relative to each other about a rotational axis; and a ratcheting assembly configured to define degrees of relative rotational movement about the rotational axis between the first arm section and the second arm section. The first and second arm sections are configured to transition between a first configuration, in which the first and second arm sections are oriented in an open position for receipt of an object between the first and second arm sections; and a second configuration, in which the first and second arm sections are oriented in a closed position, the first and second arm sections being closer to one another than when in the first configuration for clamping engagement with the object.

In accordance with this aspect, the coupling assembly includes a connecting member received within a cylindrical recess of the second arm section and secured to the first arm section in fixed disposition relative to the first arm section. The connecting member includes a circumferential edge disposed in abutting engagement with a circumferential ledge of the second arm section such that the second arm section is retained to the first arm section. The abutment of the connecting member with the second arm section and the securing of the connecting member to the first arm section serves to retain the first and second arm sections to one another for relative rotational movement about the rotational axis while precluding relative axial movement along the rotational axis. A biasing element disposed in abutting engagement with both the second arm section and with the connecting member is configured to bias the first and second arm sections from the closed position toward the open position.

The ratcheting assembly includes a release member that is retained on the connecting member and configured for sliding axial movement relative to the connecting member, but that is disposed in fixed disposition relative to the connecting member with respect to rotational movement about the rotational axis. The release member includes teeth elements disposed along a circumferential area thereof that protract in the axial direction. A rim cap is received within the cylindrical recess of the second arm section and includes a circular flange that extends outside of the second arm section to overlay and cover a surrounding edge of the cylindrical recess of the second arm section. The rim cap is secured in fixed disposition to the second arm section, and an opening in the rim cap receives therethrough a portion of the release member so as to define a release button. The rim cap further includes teeth elements disposed along a circumferential area of a rim cap. A biasing element is retained between the connecting member and the release member and is configured to bias the release member toward the rim cap such that the teeth elements of the release member engage the teeth elements of the rim cap.

Due to the shape of the inclined teeth elements and their relative dispositions, when the release member is not depressed and the teeth are in abutment with one another, relative rotational movement between the first arm section and the second arm section away from the open position toward the closed position is permitted and relative rotational movement between the first arm section and the second arm section away from the closed position toward the open position is inhibited. When the release member is depressed and the teeth are out of abutment with one another, relative rotational movement between the first arm section and the second arm section toward the open position is uninhibited.

In a feature of this aspect, the rim cap is received within the cylindrical recess in a snap-fit engagement with the second arm section.

In a feature of this aspect, the biasing element of the coupling assembly comprises a torsion spring.

In a feature of this aspect, the biasing element of the ratcheting assembly comprises a compression spring.

In a feature of this aspect, the release member is mounted via slots therein on three guides of the connecting member that protract in the axial direction for sliding movement of the release member along the rotational axis relative to the connecting member between a first position, in which the teeth elements of the release member are disposed in interlocking engagement with the teeth elements of the rim cap, and a second position, in which the teeth elements of the release member are not disposed in interlocking engagement with the teeth elements of the rim cap.

In a feature of this aspect, a spacing between teeth elements of the ratcheting assembly defines the increments in the direction of permitted relative rotational movement of the first and second arm sections.

In a feature of this aspect, the force of the biasing element of the ratcheting assembly that urges the interlocking engagement of the teeth elements is not so great as to preclude release of the first and second arm sections upon application of a sufficient torque in opening of the arm sections, whereby irreparable damage to the apparatus that otherwise would occur is avoided.

In a feature of this aspect, the release member is retained within the cylindrical recess of the second arm section by the rim cap and is configured to axially slide back and forth on the connecting member.

In a feature of this aspect, the release member is urged by the biasing element of the ratcheting assembly into a disposition in which the top of the release member extends beyond the circular flange of the rim cap, whereupon, by depressing the release member, the first and second arm sections are released from a locked condition to an unlocked condition and can be freely moved within their relative range of motion about the rotational axis. Furthermore, the biasing element of the coupling assembly may urge separation of the first and second arm sections when the release button is depressed whereby, upon ceasing depression of the release member, the teeth elements of the arm sections may return to their interlocked engagement and movement of the arm sections in increments toward the closed position may be permitted but movement of the arm sections away from the closed position may be inhibited.

In a feature of this aspect, the connecting member comprises a circular platform that is received within the cylindrical recess of the second arm section, the circular platform defining the circumferential edge abutting the circumferential ledge of the second arm section, and wherein the circumferential ledge comprises a semicircular ledge. Furthermore, the first arm section may include first and second stops that limit the range of the relative rotational movement of the arm section, and the connecting member of the coupling assembly may abut a respective one of the stops at the limits of rotational movement between the first and second arm sections, whereby repetitive circular motion of the arm sections relative to one another is inhibited and winding of electrical wires extending between the arm sections through the coupling assembly is precluded, the stops being formed by ends of the semicircular circumferential ledge of the second arm section.

In a feature of this aspect, the biasing element of the coupling assembly is secured at one end to the connecting member and at the other end abuts the second arm section.

In a feature of this aspect, each of the first and second arm sections is curved in extent between the coupling assembly and a distal end of the respective arm section.

In a feature of this aspect, each of the first and second arm sections includes electrical receptacles that are positioned adjacent each other along an extent thereof so as to define a row or "strip" of electrical receptacles.

It further should be noted that the present invention encompasses the various possible combinations of aspects and features of the various embodiments disclosed herein as well as in the incorporated references.

V. BRIEF DESCRIPTION OF THE DRAWINGS

A plurality of preferred embodiments of the present invention now will be described in detail with reference to the accompanying drawings, wherein the like elements are referred to with the same or similar reference numerals, and wherein.

VI. DETAILED DESCRIPTION

Figure 1:
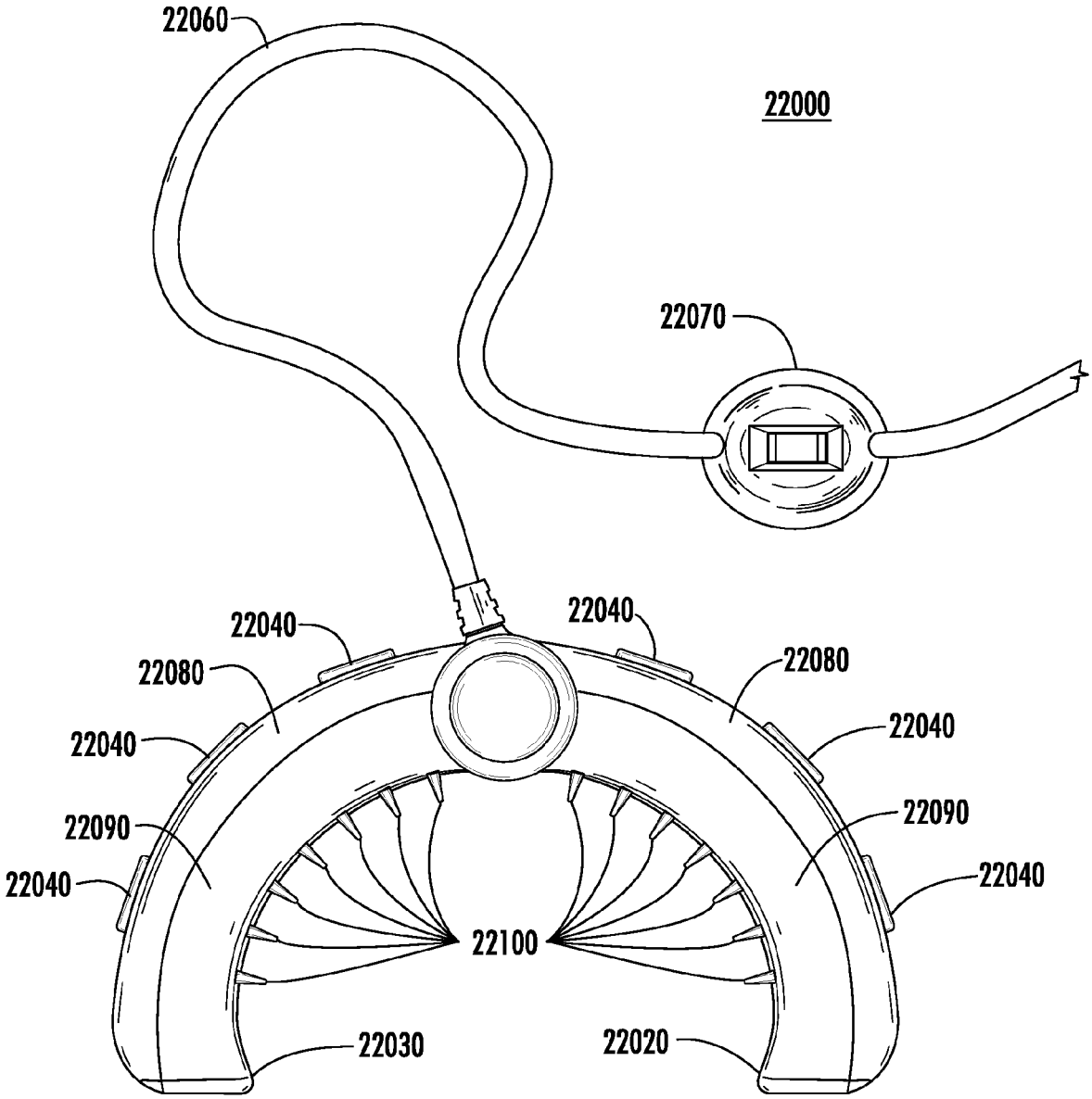
FIG. 1 is a top plan view of a power strip in an open position in accordance with an embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
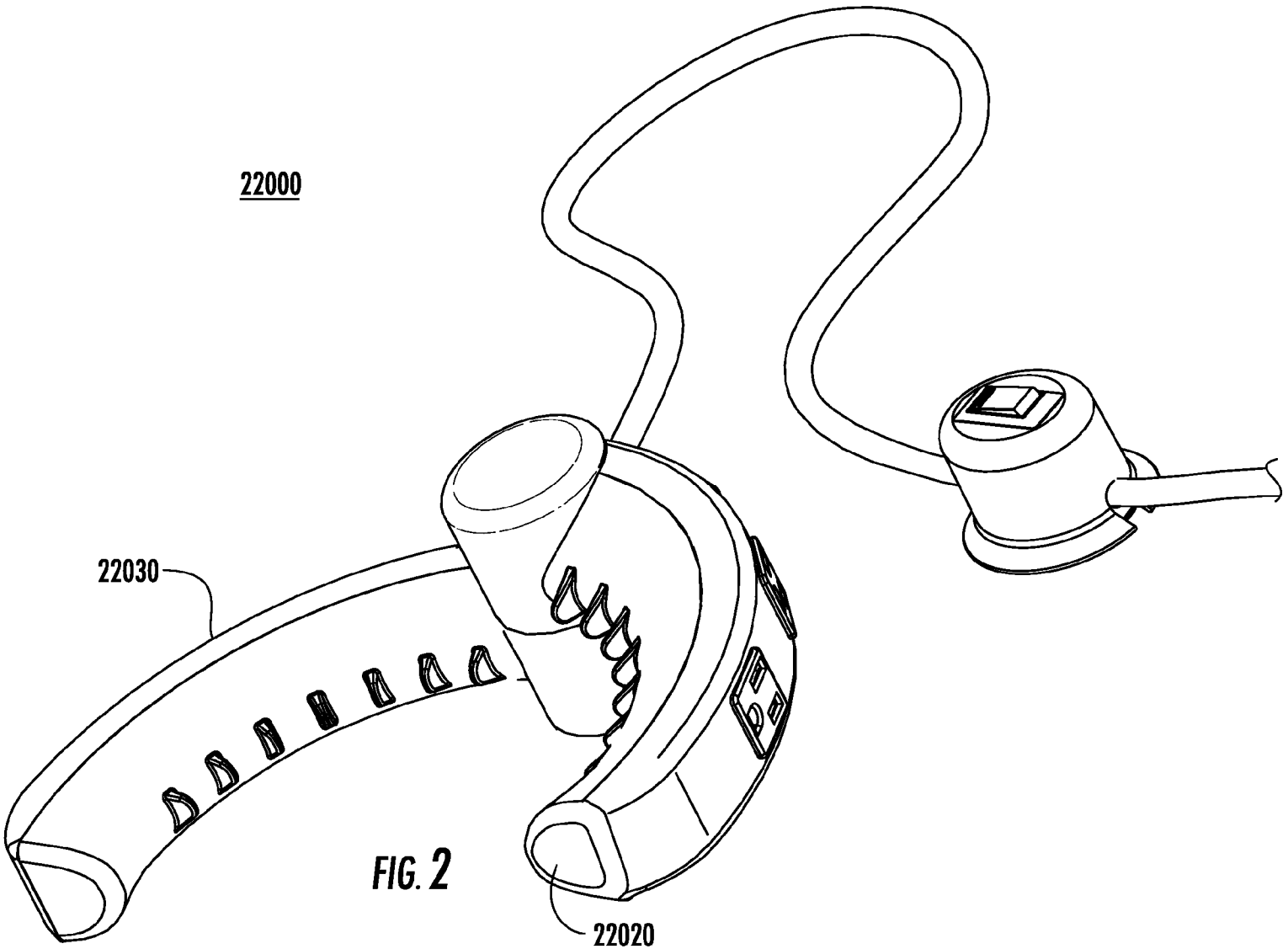
FIG. 2 is a perspective view of the power strip of FIG. 1.
Figure 3:
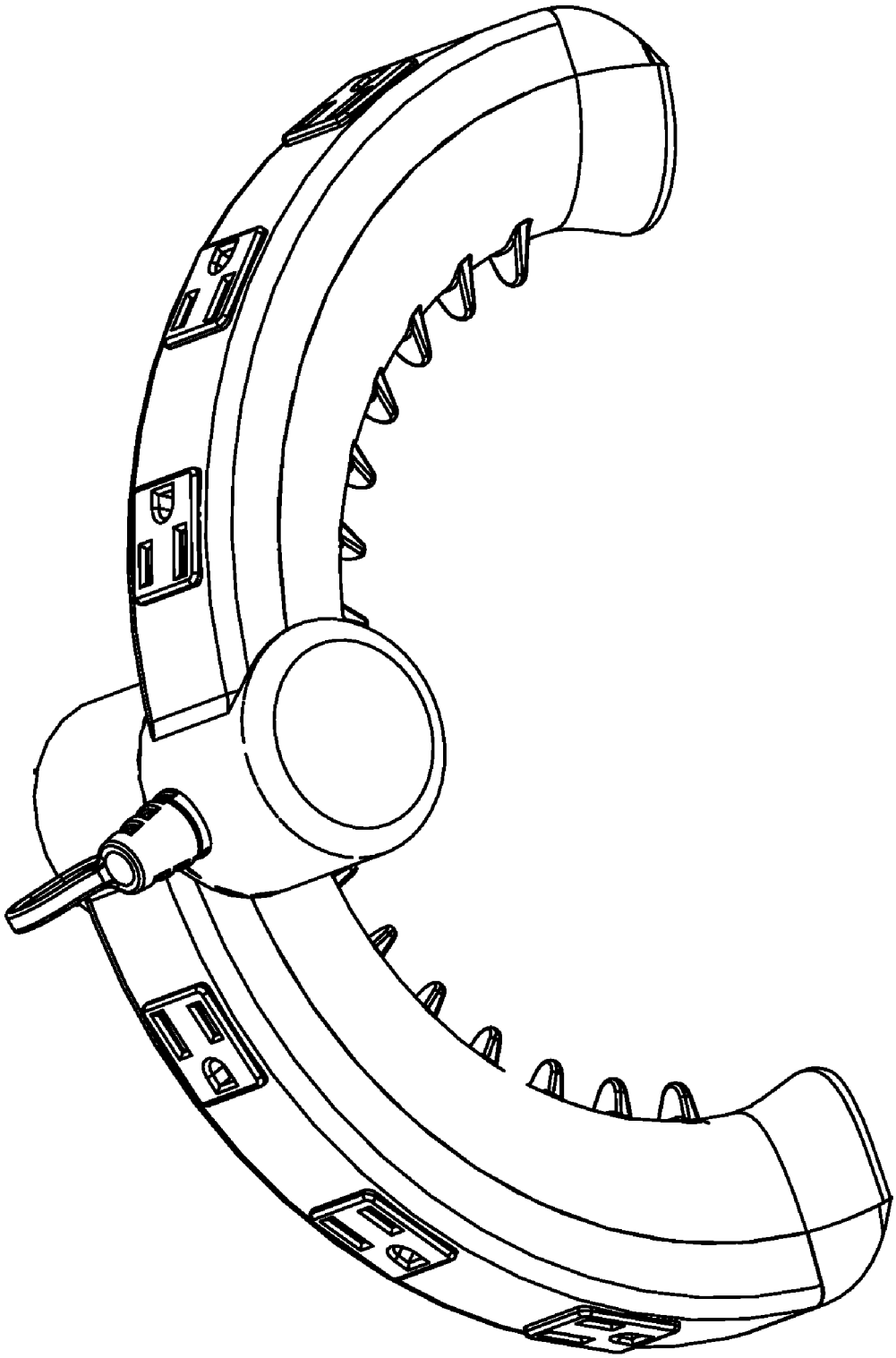
FIG. 3 is a perspective view of the power strip of FIG. 1, wherein the power cord and switch have been omitted for clarity.
Figure 4:
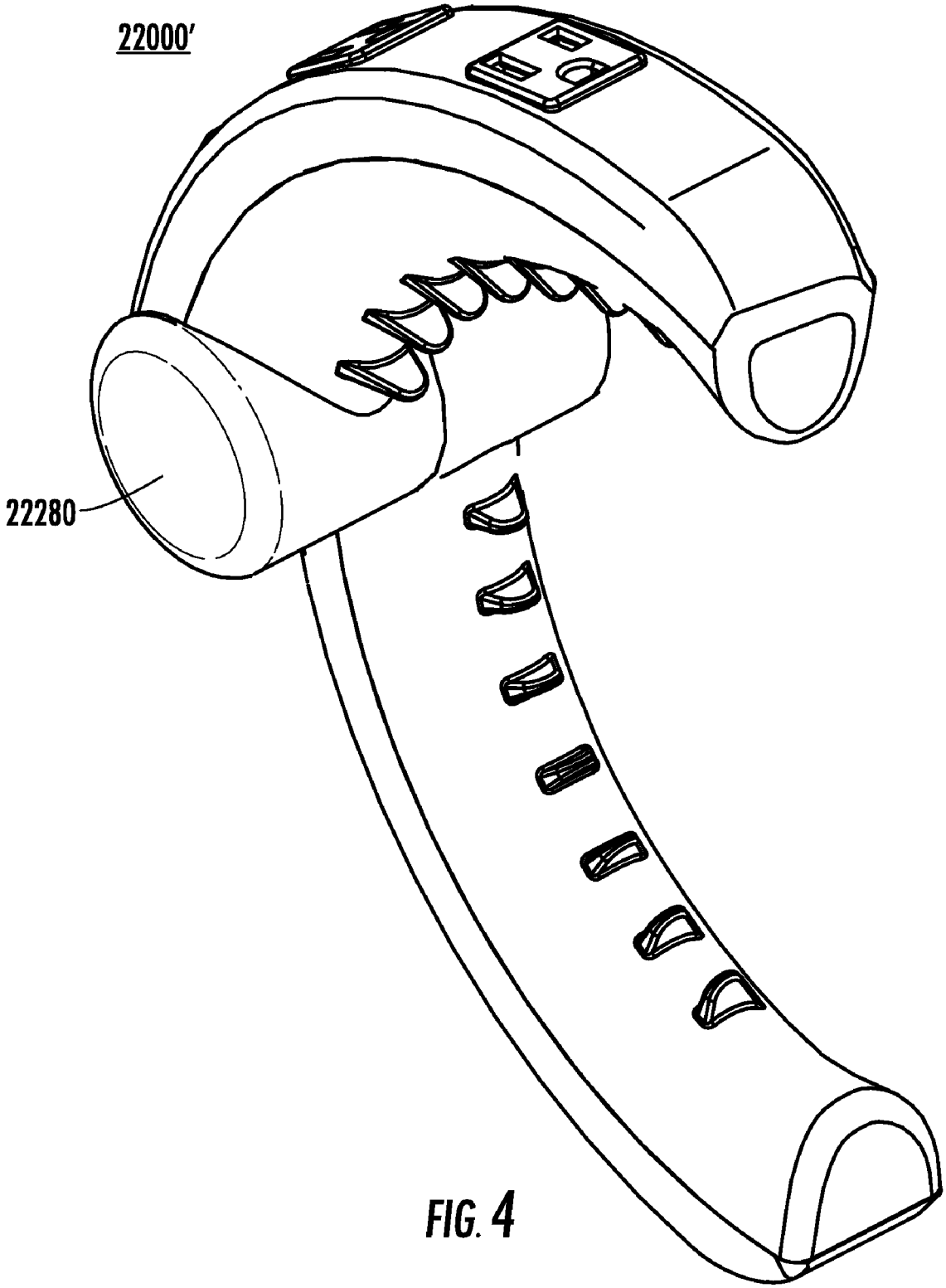
FIG. 4 is another perspective view of the power strip of FIG. 3 in an open position.
Figure 5:
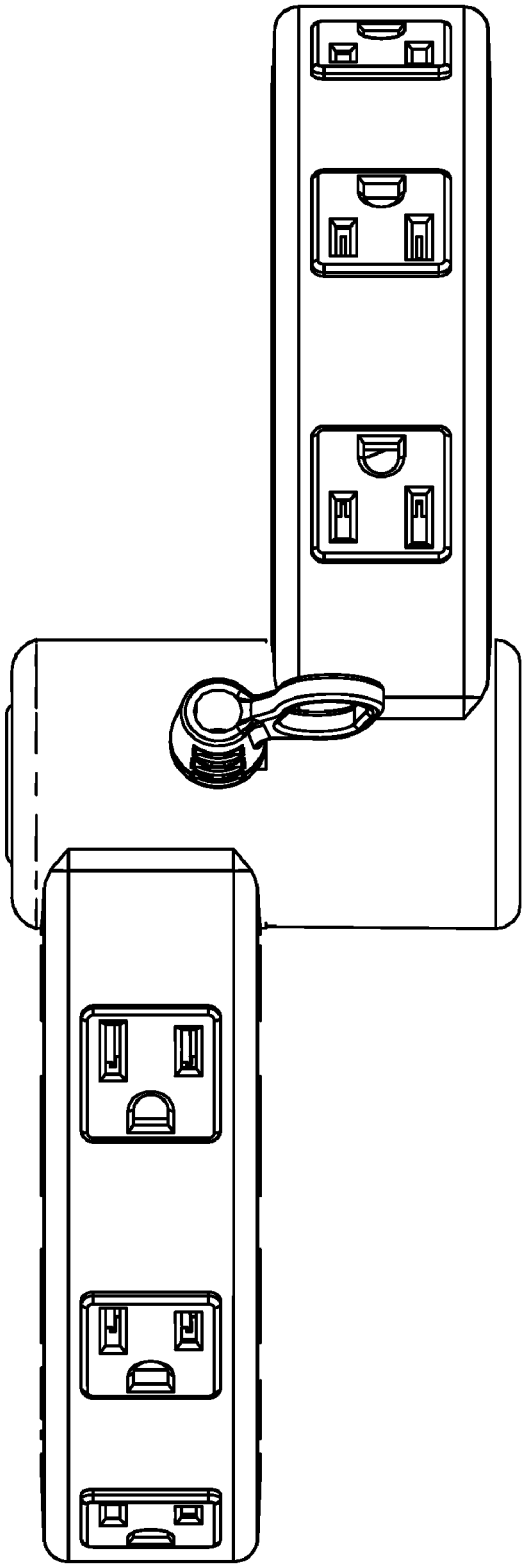
FIG. 5 is a back view of the power strip of FIG. 3 in an open position.
Figure 8:
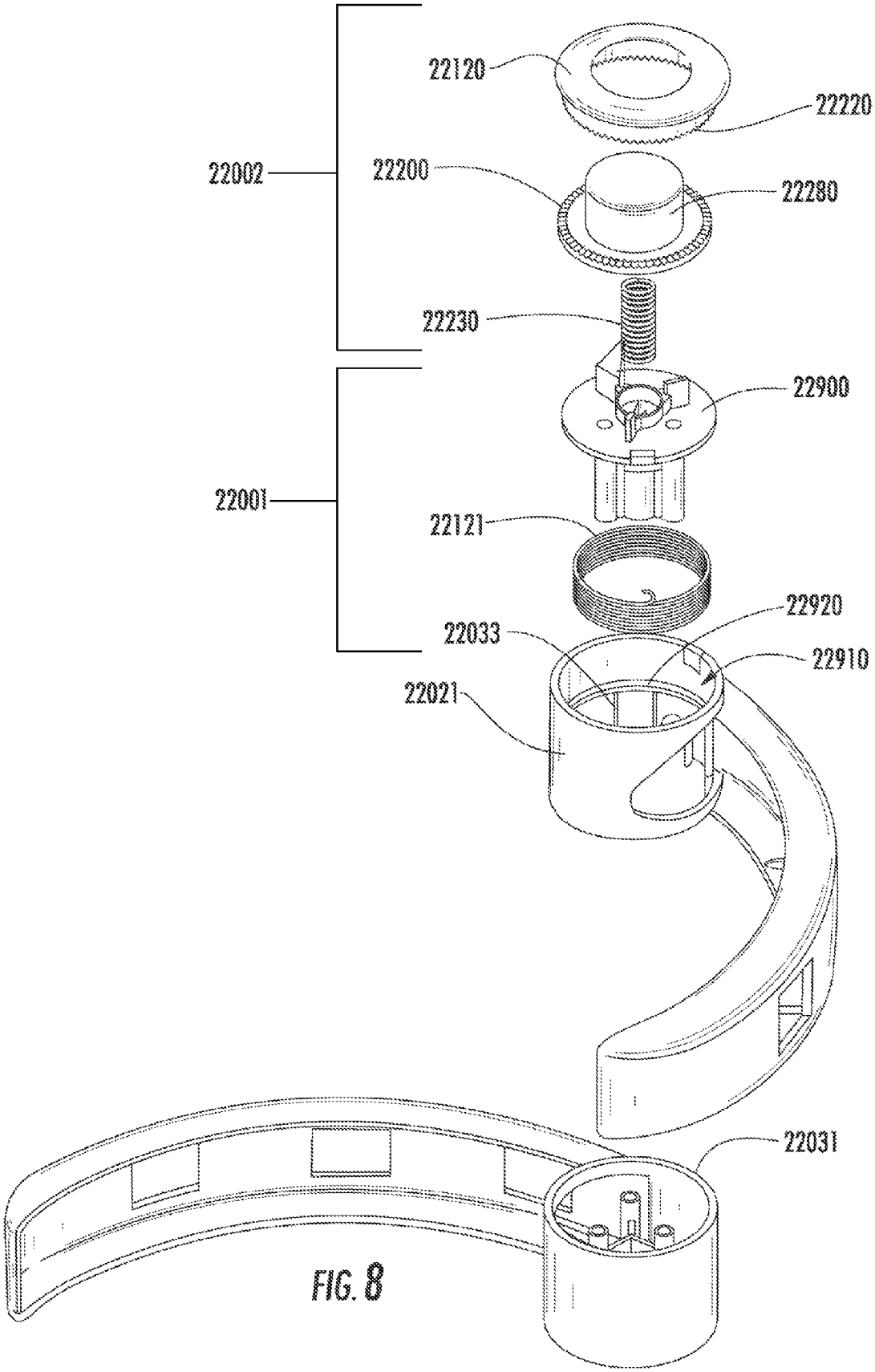
FIG. 8 is a perspective exploded view of a subset of components of the ratcheting and coupling assemblies of the power strip of FIG. 3.
Figure 9:
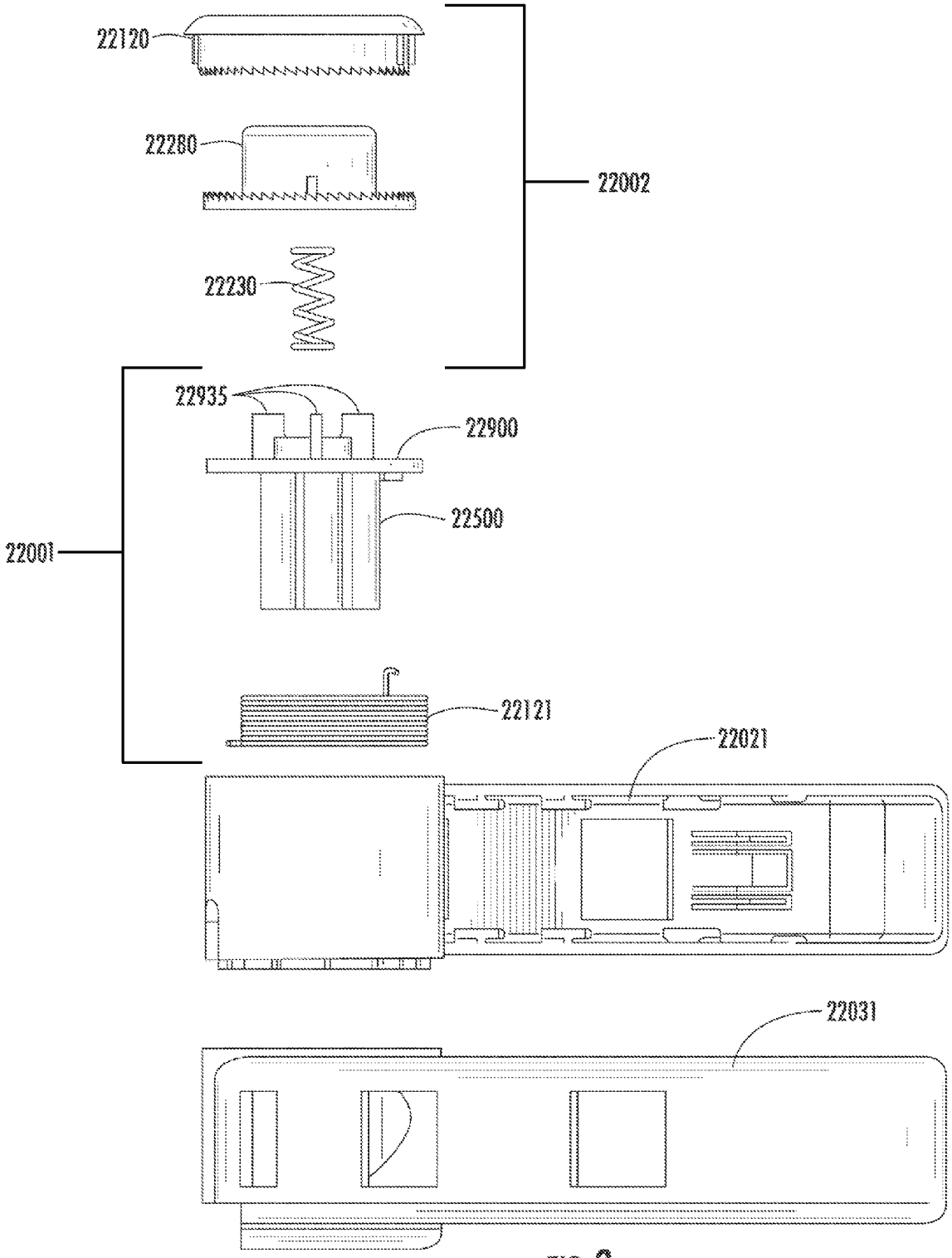
FIG. 9 is a side exploded view of the subset of components of FIG. 8.
Figure 10:
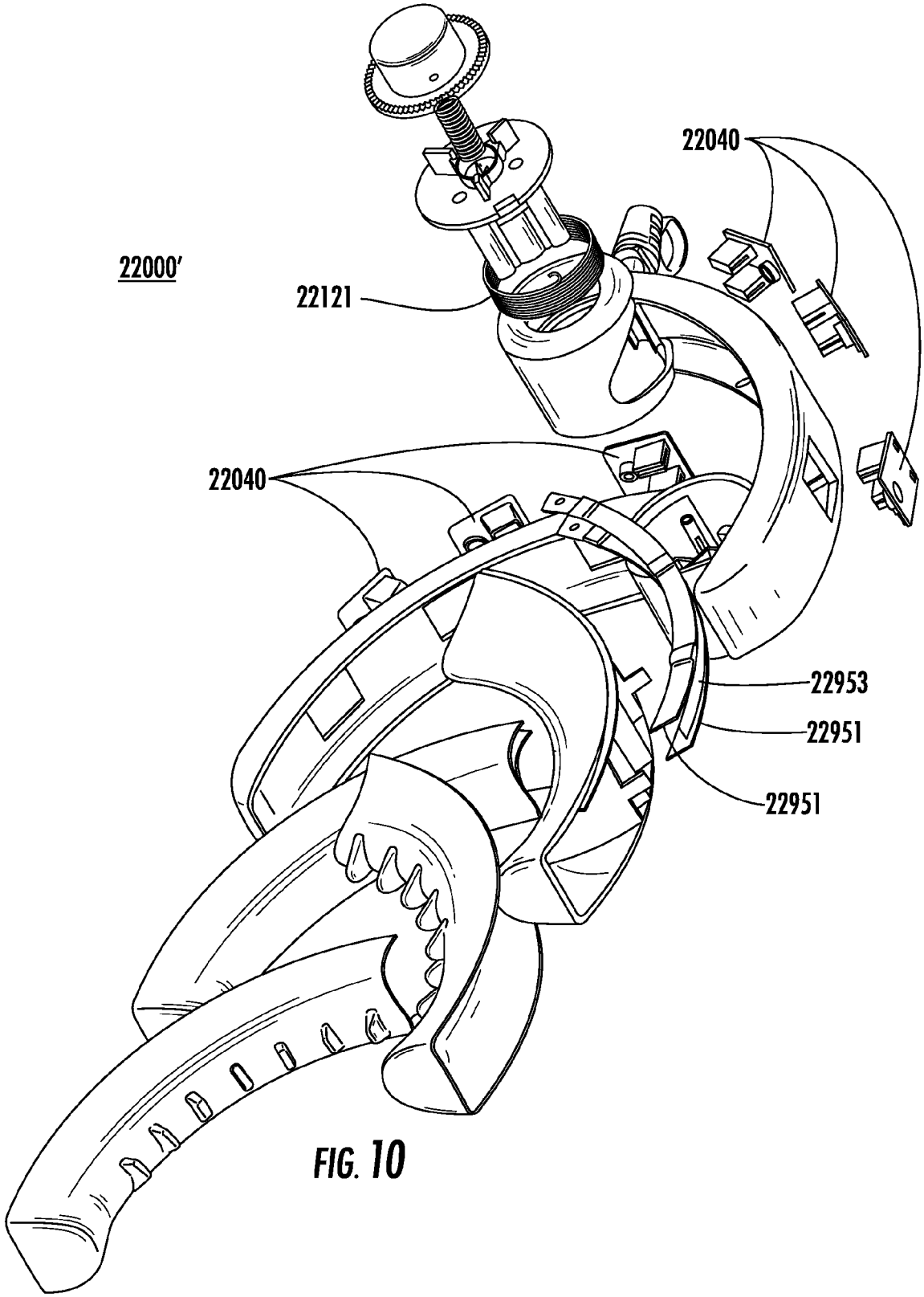
FIG. 10 is a perspective exploded view of another subset of components of the ratcheting and coupling assemblies of the power strip of FIG. 3.
Figure 11:
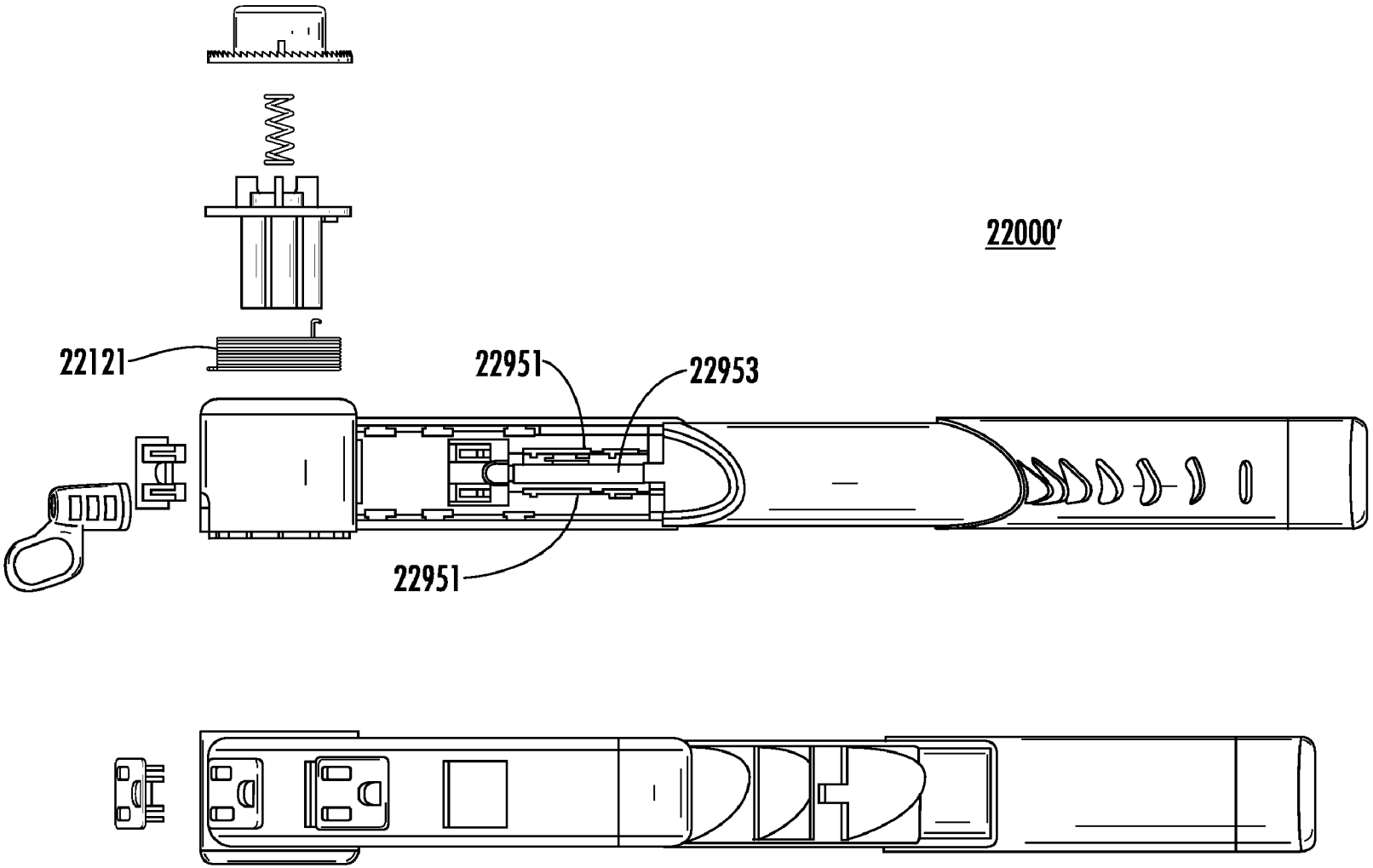
FIG. 11 is a side exploded view of the subset of components of FIG. 10.
Figure 12:
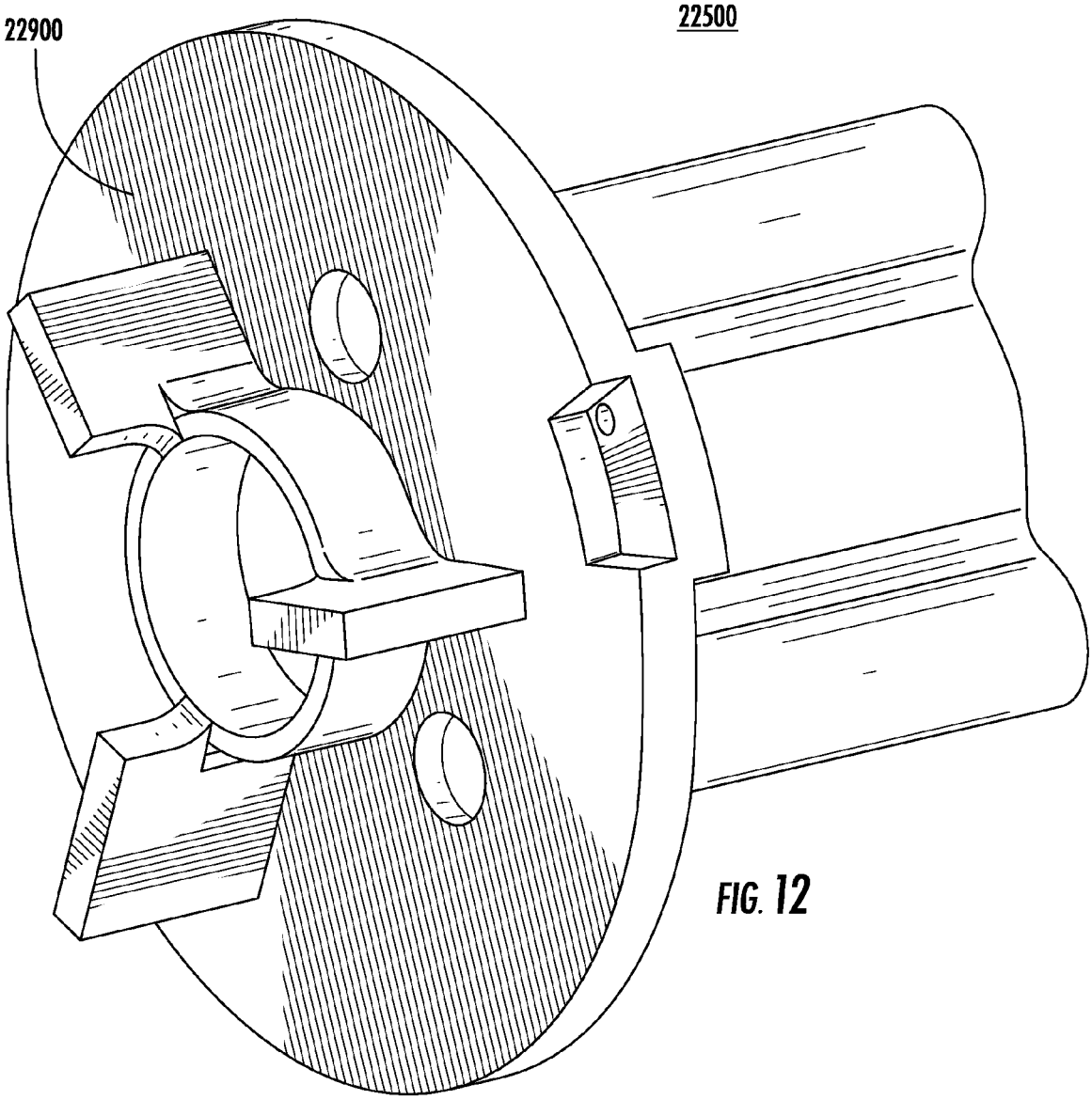
FIG. 12 is a perspective view of a connector or connecting member of the power strip of FIG. 3.
Figure 13:
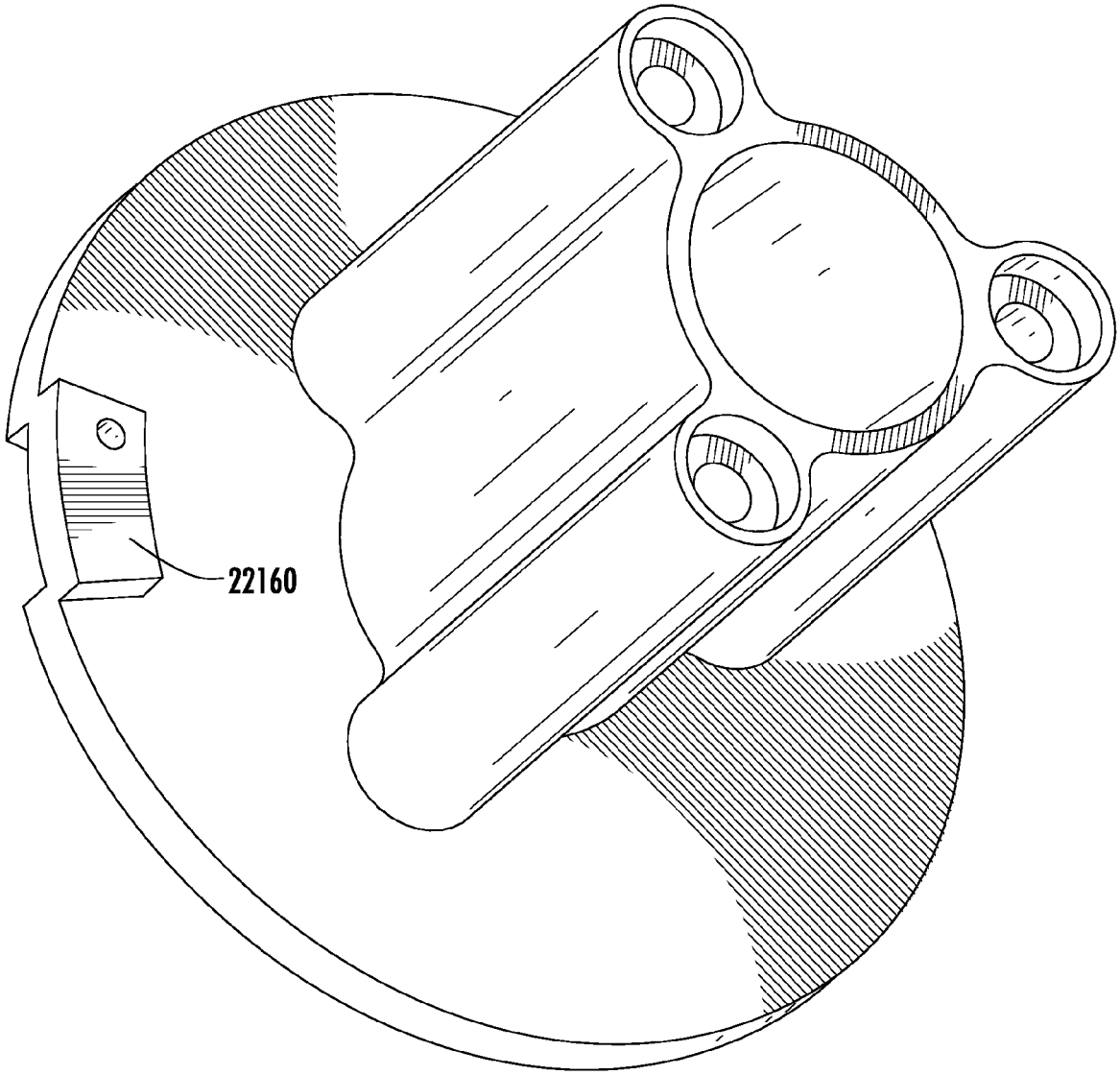
FIG. 13 is another perspective view of the connecting member of FIG. 12.
Figure 14:
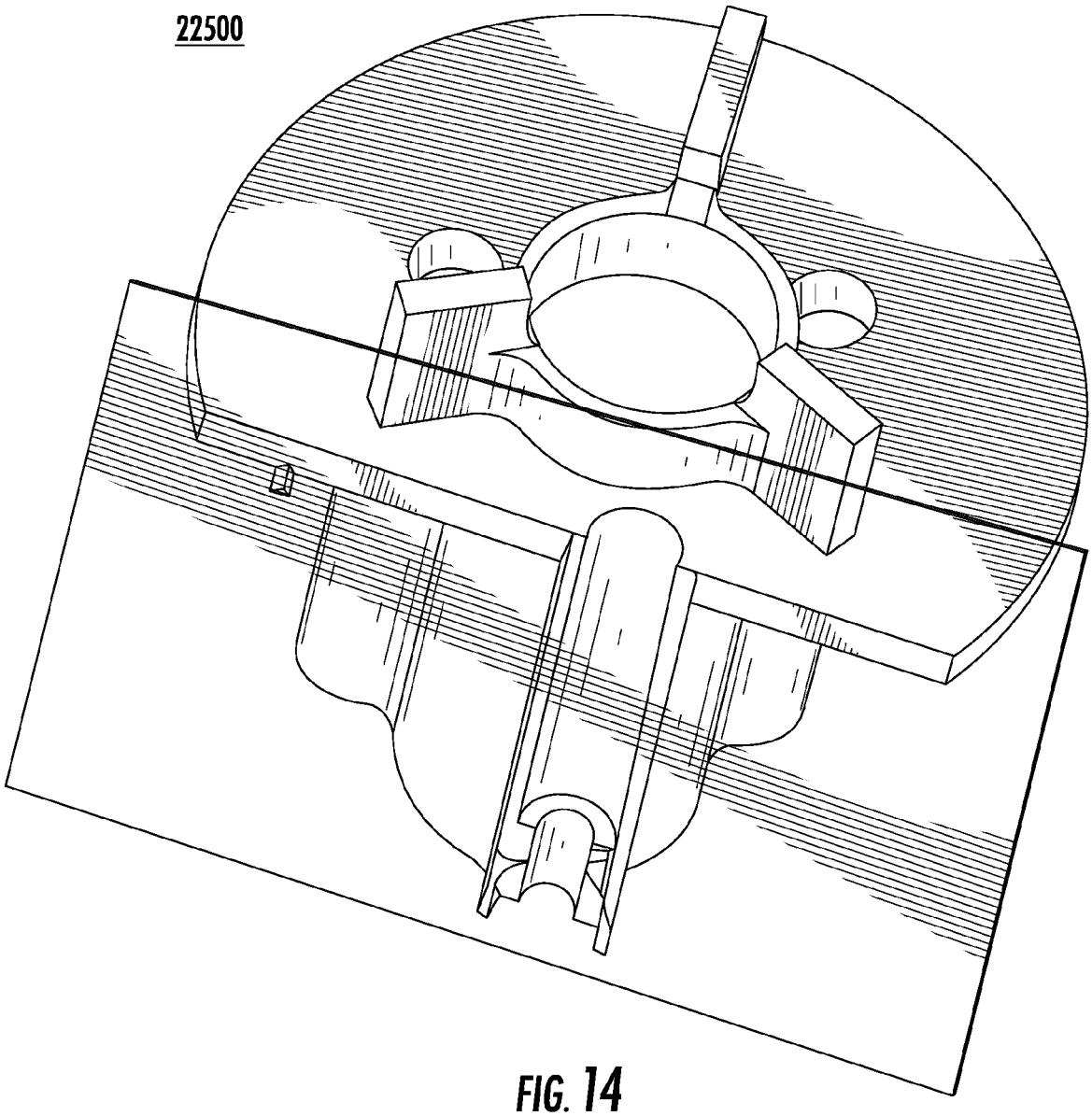
FIG. 14 is a perspective view in cross-section of the connecting member of FIG. 12.
Figure 15:
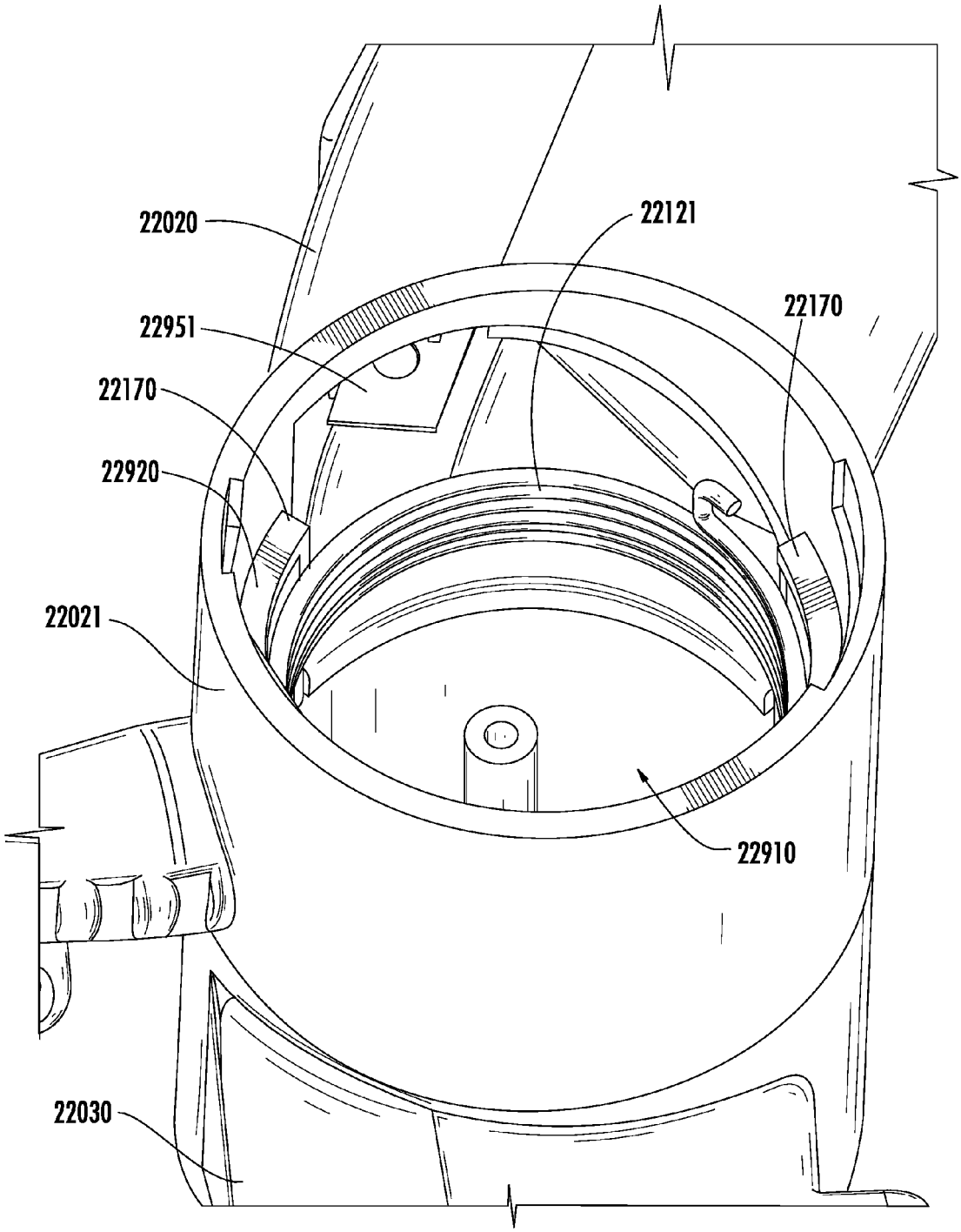
FIG. 15 is a partial perspective view of a subset of components of the power strip of FIG. 3.
Figure 16:
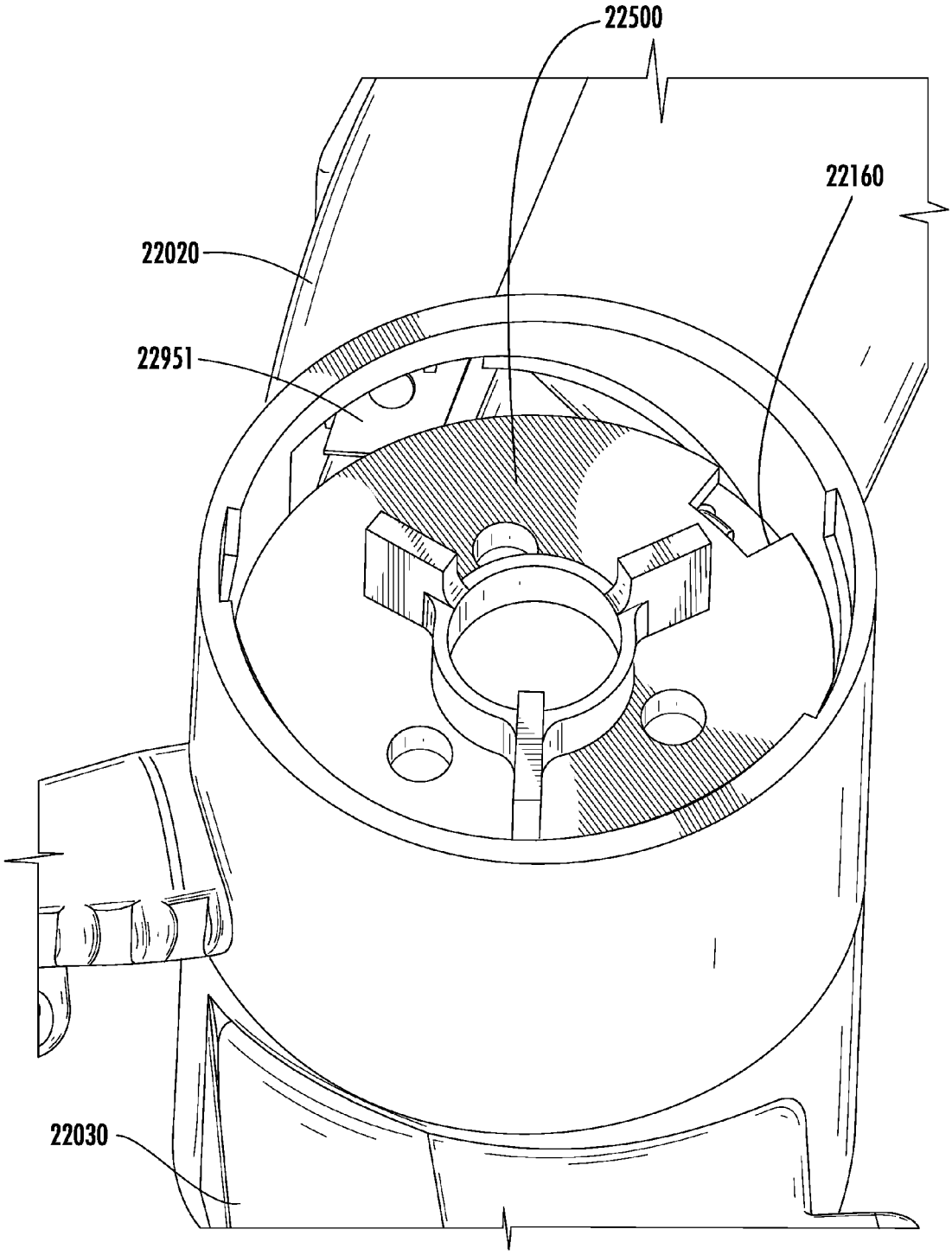
FIG. 16 is a partial perspective view of the subset of components of FIG. 15 in combination with the connection member of FIG. 12.

Turning now to the drawings, a power strip 22000 is illustrated in FIGS. 1-2 and components thereof are illustrated in FIGS. 3-17. Specifically, FIGS. 1 and 2 illustrate various views of the power strip 22000; FIGS. 3-7 illustrate various views of the power strip 22000 in each of which of the cord and the floor switch have been omitted for clarity (hereinafter the power strip is identified and referred to with callout 22000' when the cord and floor switch are not shown in the drawings); FIGS. 8-9 illustrate an exploded view of a subset of components of the ratcheting and coupling assemblies of the power strip 22000; FIGS. 10-11 illustrate an exploded view of the power strip 22000' (wherein electrical and ground strips are shown in the drawings only for one of the arm sections and have been omitted in the drawings for the other arm section, and wherein the wires and screw/bolt fasteners also have been omitted from the drawings, all for clarity of illustration); FIGS. 12-13 illustrate a connector or connecting member 22500 of the power strip 22000 that joins the two arm section together for rotational movement relative to each other about an axis extending through the connecting member 22500; FIG. 14 illustrates the connecting member 22500 of FIGS. 12-13 in cross-section taken along the plane shown in FIG. 14; and FIGS. 15-16 illustrate stops 22160,22170 of the power strip 22000, wherein the connection member 22500 is omitted in FIG. 15 and is shown in FIG. 16 in its operational arrangement in the subcomponent assembly of the power strip 22000.

Additional disclosure and discussion of power strip 22000 and components thereof can be found in the incorporated patent application publication. Indeed, additional drawings illustrating the power strip 22000—and individual components thereof—can be found in FIGS. 47-90 of the incorporated published patent application.

As shown in the drawings of the present application, the power strip 22000 includes a plurality of arm sections; a coupling assembly 22001; and a ratcheting assembly 22002, which are now described in turn below.

The Arm Sections

With respect to the arm sections 22020,22030 of the power strip 22000, each includes three standard, three-prong electrical receptacles 22040 into which electrical plugs may be individually inserted. The electrical receptacles 22040 of each respective arm section 22020,22030 are positioned adjacent each other along a curved length of the respective arm section 22020,22030 to define a row or "strip" of electrical receptacles 22040. Internal wiring—including electrical contacts 22951 and ground strip 22953 (see FIGS. 10-11)—extend through each arm section 22020,22030 for supplying power to the electrical receptacles 22040. The electrical contacts 22951 and ground strip 22953 are illustrated in the drawings with respect to only one of the arm sections, but it should be understood that the other arm section includes the same electrical contacts 22951 and ground strip 22953. A main power cord 22060 of the power strip 22000 supplies power from an external power source to the power strip 22000. In particular, the main power cord 22060 extends from the upper arm section 22020 of the power strip 22000 to, for example, a standard electrical outlet of a building (not shown). A floor switch 22070 is provided for turning on and off of the power strip 22000 by depressing a button of the floor switch 22070. As the floor switch 22070 is disposed on the floor, the floor switch 22070 may be operable with a foot. The floor switch 22070 also may be illuminated when power is provided to the power strip 22000.

Each of the arm sections 22020, 22030 includes a rigid, arcuate portion 22080 that is formed from a hard, rigid material through one or more molding processes. The molding processes may include injection molding, rotational molding, and/or blow molding. Each arm section 22020,22030 also includes an outer resilient portion 22090 that is elastic and capable of resuming its prior shape after deformation and, in particular, after compression. This resilient portion 22090 of each arm section 22020,22030 preferably comprises an over molded portion having resilient protuberances 22100 for tensioned gripping. The tensioned gripping results from compression of the resilient protuberances 22100 that occurs when the arm sections 22020,22030 are forced into a closed position about an object upon which the power strip 22000 is to be mounted.

The form of the resilient protuberances 22100 for tensioned gripping that are disposed on the inner concave portion of the arm sections 22020,22030 includes bendable or flexible fingers, which in use bend in engagement with and provide good gripping of the object to which the power strip 22000 is mounted.

Moreover, each protuberance 22100 is asymmetrical and includes a steeper slope on one side thereof relative to the slope on the other side thereof. The asymmetry of each individual protuberance 22100 is perhaps best seen in FIGS. 6 and 7.

The protuberances 22100 also are aligned in two generally parallel rows, each row of which is generally offset from a centerline of its respective arm section 22020,22030 in a direction toward the other row of the other arm section 22020, 22030. This arrangement of the two rows of protuberances 22100 is best seen, for example, in FIG. 6.

Figure 6:
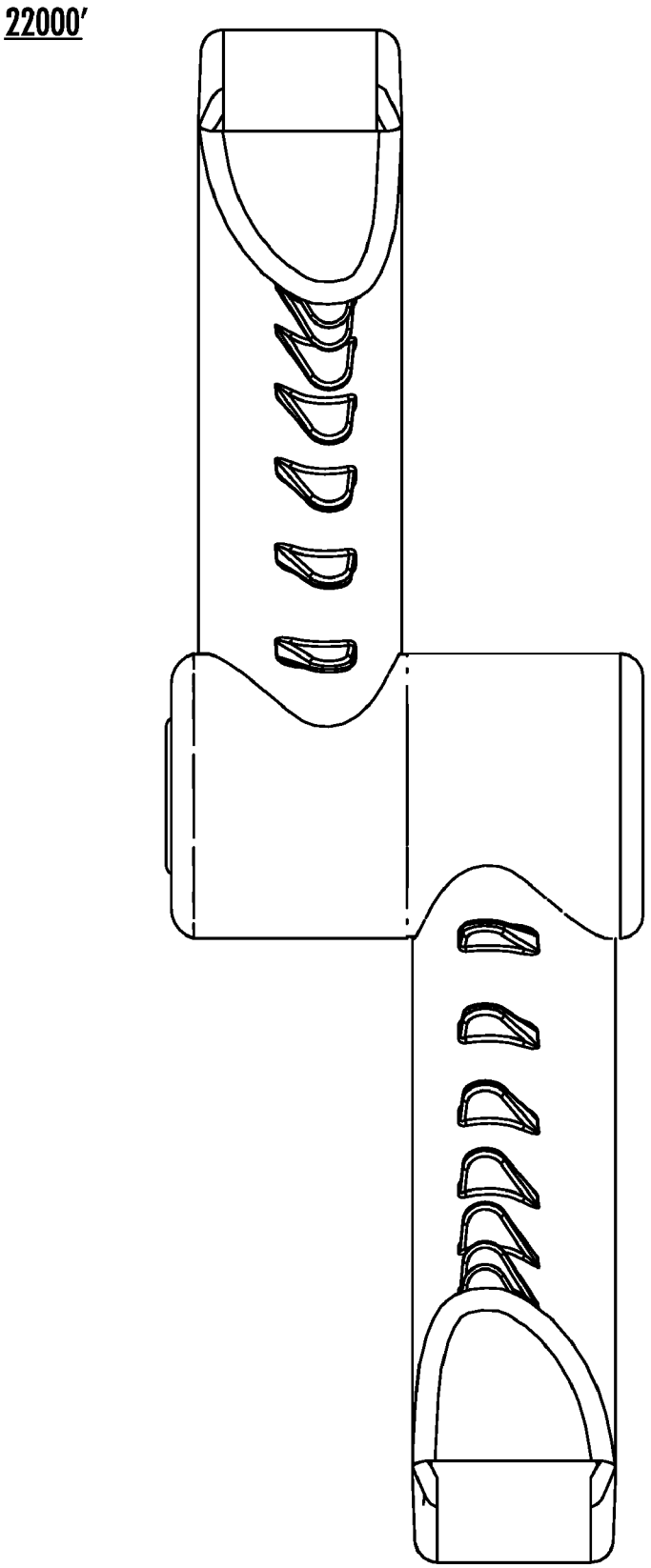
FIG. 6 is a front view of the power strip of FIG. 3 in an open position.
Figure 7:
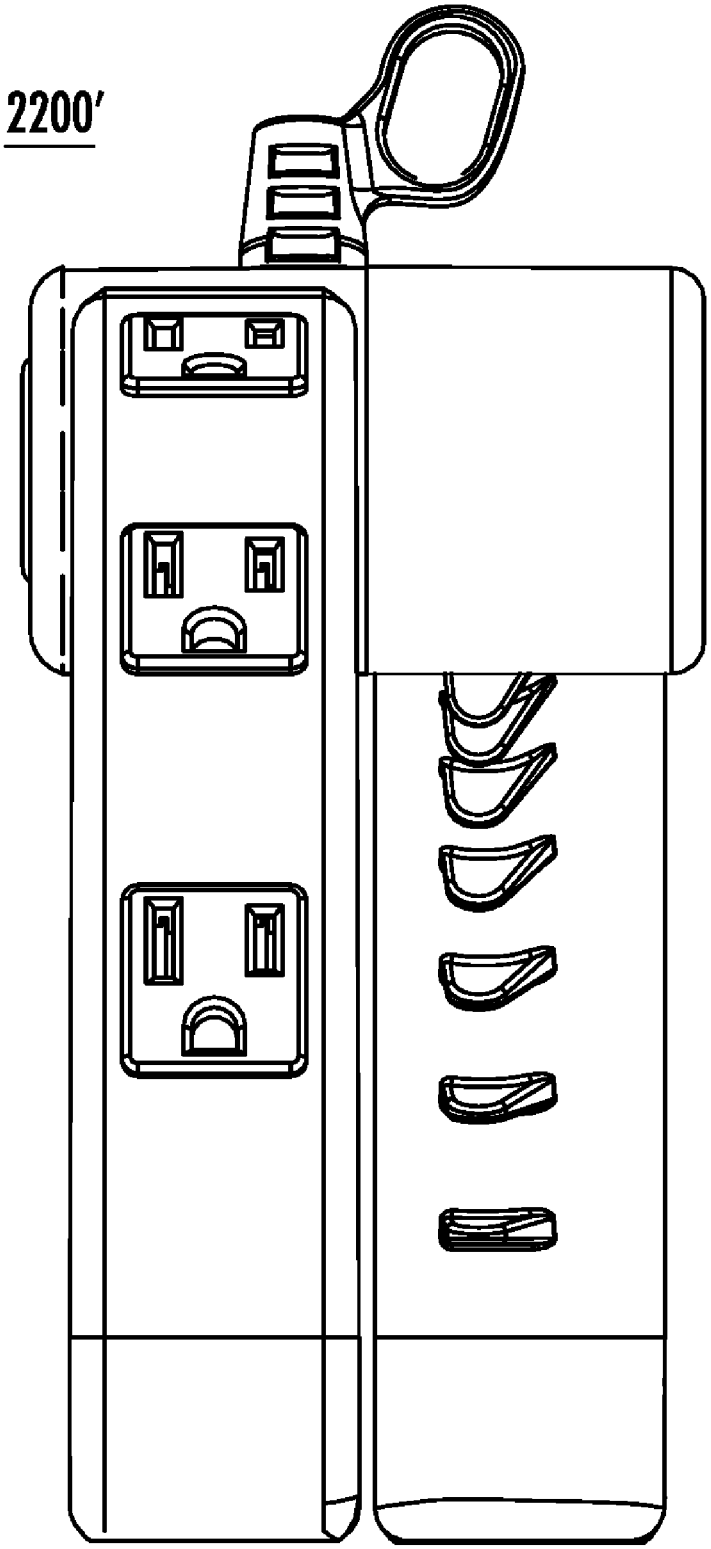
FIG. 7 is a side view of the power strip of FIG. 3 in a closed position.

Each arm section 22020,22030 further includes a profile that is asymmetrical along the respective centerline of the arm section, again as best seen, for example, in FIG. 6. The profile of each arm section 22020,22030 includes a rounded edge that is offset toward the other arm section 22020,22030, with the protuberances 22100 on each arm section 22020,22030 extending along this rounded edge.

The Coupling Assembly

The coupling assembly 22001 of the power strip 22000 serves to couple the two arm sections 22020,22030 together. With particular reference to FIGS. 8-16, the coupling assembly 22001 includes a connecting member 22500 that is secured to the lower arm section 22030 and, specifically, that is secured to a body 22031 of the lower arm section 22030, via three fasteners (not shown) such as screws or bolts. The connecting member 22500 also includes a circular platform 22900 that is received within a cylindrical recess 22910 of a body 22021 of the upper arm section 22020 and that abuts a circumferential ledge 22920 of the body 22021 of the upper arm section 22020. This abutment of the connecting member 22500 with the upper arm section 22020 and its mounting to the lower arm section 22030 via the three fasteners serves to retain the upper and lower arm sections 22020,22030 to one another for relative rotational movement about an axis of the connecting member 22500 while precluding relative axial movement along such axis.

A torsion spring 22121 also is provided that biases the arm sections from a closed position toward an open position. The torsion spring 22121 is secured at one end to the connecting member 22500 and abuts one of a plurality of ribs 22033 formed in the body 22021 of the upper arm section 22020 such that relative rotational movement of the arm sections 22020,22030 toward the closed position results in tensioning of the torsion spring 22121. The torsion spring 22121 thus serves to bias the arm sections 22020,22030 in a rotational direction from a closed position toward an open position. In variations, a torsion spring could be configured to bias the arm sections in a rotational direction from a closed position toward an open position.

The Ratchet Assembly

The ratchet assembly 22002 defines steps or degrees of relative rotational movement between the first arm section 22020 and the second arm section 22030. The ratchet assembly 22002 also selectively permits rotational movement of the arm sections 22020,22030 toward one another while precluding rotational movement of the arm sections 22020,22030 away from one another.

In this respect, the ratchet assembly 22002 includes inclined teeth elements 22200 disposed along a circumferential area of the release member 22280 that protract in the axial direction to engage corresponding inclined teeth elements 22220 disposed along a circumferential area of a rim cap 22120. The rim cap 22120 is received within the cylindrical recess of the upper arm section 22020 and includes a portion or circular flange that extends outside thereof to overlay and cover the surrounding edge of the cylindrical recess of the upper arm section 22020. The rim cap 22120 further preferably is received within the cylindrical recess in a snapfit engagement whereby the rim cap 22120 is secured to the upper arm section 22020 in fixed disposition relative thereto. An opening in the rim cap 22120 receives therethrough a portion of release member 22280 to thereby define a "release button."

The teeth elements 22200 are urged into engagement with the inclined teeth elements 22220 by a respective biasing element comprising a compression spring 22230. Due to the shape of the inclined teeth elements 22200,22220 and their relative dispositions, the ratchet assembly 22002 permits relative rotational movement between the first arm section 22020 and the second arm section 22030 toward one another and precludes or inhibits relative rotational movement between the first arm section 22020 and the second arm section 22030 away from one another. The spacing between the teeth elements 22200,22220 of the ratchet assembly defines the increments in the direction of permitted relative rotational movement of the arm sections 22020,22030.

The compression spring 22230 is disposed between and abuts the circular platform 22900 of the connecting member 22500 and the release member 22200, and the release member 22200 is mounted via slots therein on three guides 22935 of the connecting member 22500 that protract in the axial direction for sliding movement along the axis thereof relative to the connecting member 22500 between a first position, in which the teeth elements 22200,22220 are in interlocking engagement, and a second position, in which the teeth elements 22200,22220 are out of interlocking engagement. Preferably, while the compression spring 22230 urges interlocking engagement of the teeth elements 22200,22220, the spring force preferably is not so great as to preclude release of the arm sections 22020,22030 if a great amount of torque is applied so that irreparable damage to the power strip 22000 that otherwise would occur is avoided.

The release member 22280 comprises a portion that is exposed and serves as a "button" for release of the locking engagement of the teeth elements 22200,22220 and may include the word "PUSH" or other indicia, such as a logo or trademark, located on a surface thereof. The release member 22280 is retained within the rim cap 22120 and is configured to slide back and forth in the axial direction. The release member 22280 is biased by the compression spring into a disposition in which the top of the release member 22280 is raised above the circular flange of the rim cap 22120.

Operation

In operation, the power strip 22000 may be clamped onto an object or portion thereof, such as, for example, a trunk or branch of a tree, a stud in a building under construction, or a work bench or table. By depressing the release member 22280, the two arm sections 22020,22030 are released from a locked condition to an unlocked condition and can be freely moved within their relative range of motion about their mutual pivot axis of the connection member 22500. Moreover, the torsion spring 22121 preferably causes the arm sections 22020,22030 to separate when the release button 22280 is depressed. The power strip 22000 then can be positioned such that the object (or portion thereof) is disposed between the arm sections 22020,22030. Upon ceasing depression of the release member 22280 (which is biased by the compression spring 22230), the teeth elements 22200, 22220 of the arm sections 22020,22030 will return to their interlocked engagement such that movement of the arm sections 22020,22030 in increments toward one another will be permitted but movement of the arm sections 22020,22030 away from one another will be precluded or inhibited. The arm sections 22020,22030 then can be closed in tight fitting disposition on the object located there between for mounting of the power strip 22000 to the object.

Additionally, in order to inhibit repetitive circular motion of the arm sections 22020,22030 relative to one another, which would tend to cause winding of any electrical wires extending between the arm sections 22020,22030 through the coupling assembly 22001, stops preferably are provided for limiting the range of the relative rotational movement of the arm section 22020,22030. In this respect, a stop 22160 (see FIG. 13) is provided on the connection member 22500 that engages corresponding stops 22170 provided on the upper arm section 22020 which serves to limit the range of relative rotational movement of the arm sections 22020,22030. The stops 22170 preferably are formed by the ends of the semicircular circumferential ledge of the upper arm section 22020 against which the connection member 22500 abuts when it is secured to the lower arm section 22030. The stops 22160, 22170 are best illustrated in FIGS. 15-16. The connection member 22500 is omitted in FIG. 15, and the connection member 22500 is shown in FIG. 16. These two drawings further illustrates the connection of the torsion spring 22121 to the connection member 22500.

Closing

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An apparatus, comprising:

(a) a plurality of arm sections, at least one of the plurality of arm sections including a plurality of electrical receptacles;

(b) a coupling assembly configured to couple together a first arm section of the plurality of arm sections and a second arm section of the plurality of arm sections for rotational movement relative to each other about a rotational axis; and (c) a ratcheting assembly configured to define degrees of relative rotational movement about the rotational axis between the first arm section and the second arm section;

(d) wherein the first and second arm sections are configured to transition between, (i) a first configuration, in which the first and second arm sections are oriented in an open position for receipt of an object between the first and second arm sections, and (ii) a second configuration, in which the first and second arm sections are oriented in a closed position, the first and second arm sections being closer to one another than when in the first configuration for clamping engagement with the object;

(e) wherein the coupling assembly comprises a connecting portion of the first arm section that is received within a recess of the second arm section in abutting engagement with the second arm section such that the second arm section is retained to the first arm section, the abutment of the connecting portion with the second arm section serving to retain the first and second arm sections to one another for relative rotational movement about the rotational axis while precluding relative axial movement along the rotational axis; and (f) wherein the ratcheting assembly comprises, (i) a release member configured for sliding movement along the rotational axis relative to the connecting portion, but disposed in fixed disposition relative to the connecting portion with respect to rotational movement about the rotational axis, the release member including teeth elements and the second arm section further including an engaging portion having corresponding teeth elements, and (ii) a biasing element configured to bias the release member along the rotational axis and the teeth elements of the release member into engagement with the teeth elements of the engaging portion of the second arm section such that, due to the shape of the inclined teeth elements and their relative dispositions, (A) when the release member is not depressed and the teeth elements of the release member are engaged with the teeth elements of the engaging portion, (I) relative rotational movement between the first arm section and the second arm section away from the open position toward the closed position is permitted, and (II) relative rotational movement between the first arm section and the second arm section away from the closed position toward the open position is inhibited, and (B) when the release member is depressed and the teeth elements of the release member are out of engagement with the teeth elements of the engaging portion, relative rotational movement between the first arm section and the second arm section toward the open position is uninhibited.

2. The apparatus of claim 1, further comprising a torsion spring disposed in abutting engagement with both the second arm section and with the connecting portion of the first arm section and configured to bias the first and second arm sections from the closed position toward the open position, whereby the arm sections are spring-biased toward an open position for receiving an object therebetween for mounting of the apparatus to the object.

3. The apparatus of claim 1, wherein the connecting portion of the first arm section comprises a connecting member that is secured to a body of the first arm section in fixed disposition relative thereto.

4. The apparatus of claim 1, wherein the engaging portion of the second arm section comprises a rim cap that is received within a cylindrical recess of the second arm section and that includes a circular flange extending outside of the cylindrical recess of the second arm section to overlay and cover a surrounding edge of the second arm section, the rim cap being secured in fixed disposition relative to the second arm section, an opening in the rim cap receiving therethrough an extended portion of the connecting portion of the first arm section that defines a release button, the rim cap further including a circumferential area along which the teeth elements are arranged.

5. The apparatus of claim 1, wherein the biasing element of the ratcheting assembly comprises a compression spring.

6. An apparatus, comprising:

(a) a plurality of arm sections, at least one of the plurality of arm sections including a plurality of electrical receptacles;

(b) a coupling assembly configured to couple together a first arm section and a second arm section of the plurality of arm sections for rotational movement relative to each other about a rotational axis; and (c) a ratcheting assembly configured to define degrees of relative rotational movement about the rotational axis between the first arm section and the second arm section;

(d) wherein the first and second arm sections are configured to transition between, (i) a first configuration, in which the first and second arm sections are oriented in an open position for receipt of an object between the first and second arm sections, and (ii) a second configuration, in which the first and second arm sections are oriented in a closed position, the first and second arm sections being closer to one another than when in the first configuration for clamping engagement with the object;

(e) wherein the coupling assembly comprises, (i) a connecting member received within a cylindrical recess of the second arm section and secured to the first arm section in fixed disposition relative to the first arm section, the connecting member including a circumferential edge disposed in abutting engagement with a circumferential ledge of the second arm section such that the second arm section is retained to the first arm section, the abutment of the connecting member with the second arm section and the securing of the connecting member to the first arm section serving to retain the first and second arm sections to one another for relative rotational movement about the rotational axis while precluding relative axial movement along the rotational axis, and (ii) a biasing element of the coupling assembly disposed in abutting engagement with both the second arm section and with the connecting member and configured to bias the first and second arm sections from the closed position toward the open position; and (f) wherein the ratcheting assembly comprises, (i) a release member retained on the connecting member and configured for sliding axial movement relative to the connecting member but disposed in fixed disposition relative to the connecting member with respect to rotational movement about the rotational axis, the release member including teeth elements disposed along a circumferential area thereof that protract in the axial direction, (ii) a rim cap received within the cylindrical recess of the second arm section and including a circular flange extending outside of the second arm section to overlay and cover a surrounding edge of the cylindrical recess of the second arm section, the rim cap secured in fixed disposition to the second arm section, an opening in the rim cap receiving therethrough a portion of the release member to define a release button, the rim cap further including teeth elements disposed along a circumferential area of a rim cap, (iii) a biasing element of the ratcheting assembly retained between the connecting member and the release member and configured to bias the release member along the rotational axis toward the rim cap such that the teeth elements of the release member engage the teeth elements of the rim cap, (iv) whereby, due to the shape of the inclined teeth elements and their relative dispositions, (A) relative rotational movement between the first arm section and the second arm section away from the open position toward the closed position is permitted and relative rotational movement between the first arm section and the second arm section away from the closed position toward the open position is inhibited when the release member is not depressed and the teeth are in abutment with one another, and (B) relative rotational movement between the first arm section and the second arm section toward the open position is uninhibited when the release member is depressed and the teeth are out of abutment with one another.

7. The apparatus of claim 6, wherein the rim cap further preferably is received within the cylindrical recess in a snap-fit engagement with the second arm section.

8. The apparatus of claim 6, wherein the biasing element of the coupling assembly comprises a torsion spring.

9. The apparatus of claim 6, wherein the biasing element of the ratcheting assembly comprises a compression spring.

10. The apparatus of claim 6, wherein the release member is mounted via slots therein on three guides of the connecting member that protract in the axial direction for sliding movement of the release member along the rotational axis relative to the connecting member between a first position, in which the teeth elements of the release member are disposed in interlocking engagement with the teeth elements of the rim cap, and a second position, in which the teeth elements of the release member are not disposed in interlocking engagement with the teeth elements of the rim cap.

11. The apparatus of claim 6, wherein spacing between teeth elements of the ratcheting assembly defines the increments in the direction of permitted relative rotational movement of the first and second arm sections.

12. The apparatus of claim 6, wherein the force of the biasing element of the ratcheting assembly that urges the interlocking engagement of the teeth elements is not so great as to preclude release of the first and second arm sections upon application of a sufficient torque in opening of the arm sections, whereby irreparable damage to the apparatus that otherwise would occur is avoided.

13. The apparatus of claim 6, wherein the release member is retained within the cylindrical recess of the second arm section by the rim cap and is configured to axially slide back and forth on the connecting member.

14. The apparatus of claim 6, wherein the release member is urged by the biasing element of the ratcheting assembly into a disposition in which the top of the release member extends beyond the circular flange of the rim cap, whereupon, by depressing the release member, the first and second arm sections are released from a locked condition to an unlocked condition and can be freely moved within their relative range of motion about the rotational axis.

15. The apparatus of claim 14, wherein the the biasing element of the coupling assembly urges separation of the first and second arm sections when the release button is depressed and, upon ceasing depression of the release member, the teeth elements of the arm sections return to their interlocked engagement and movement of the arm sections in increments toward the closed position is permitted but movement of the arm sections away from the closed position is inhibited.

16. The apparatus of claim 6, wherein the connecting member comprises a circular platform that is received within the cylindrical recess of the second arm section, the circular platform defining the circumferential edge abutting the circumferential ledge of the second arm section, and wherein the circumferential ledge comprises a semicircular ledge.

17. The apparatus of claim 16, wherein the first arm section comprises first and second stops that limit the range of the relative rotational movement of the arm section, and wherein the connecting member of the coupling assembly abuts a respective one of the stops at the limits of rotational movement between the first and second arm sections, whereby repetitive circular motion of the arm sections relative to one another is inhibited and winding of electrical wires extending between the arm sections through the coupling assembly is precluded, the stops being formed by ends of the semicircular circumferential ledge of the second arm section.

18. The apparatus of claim 6, wherein the biasing element of the coupling assembly is secured at one end to the connecting member and at the other end abuts the second arm section.

19. The apparatus of claim 6, wherein each of the first and second arm sections is curved in extent between the coupling assembly and a distal end of the respective arm section.

20. The apparatus of claim 6, wherein each of the first and second arm sections includes electrical receptacles that are positioned adjacent each other along an extent thereof so as to define a row or "strip" of electrical receptacles.

* * * * *